US007136609B2

(12) United States Patent
Askren et al.

(10) Patent No.: US 7,136,609 B2
(45) Date of Patent: Nov. 14, 2006

(54) MOVABLE SUBUNIT AND TWO PIECE CARTRIDGE FOR USE IN AN IMAGE FORMING DEVICE

(75) Inventors: Benjamin Alan Askren, Lexington, KY (US); Larry Steven Foster, Lexington, KY (US); Edward Lynn Triplett, Lexington, KY (US); David Erwin Rennick, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/804,628

(22) Filed: Mar. 19, 2004

(65) Prior Publication Data

US 2005/0207781 A1 Sep. 22, 2005

(51) Int. Cl.
*G03G 15/00* (2006.01)

(52) U.S. Cl. ..... 399/110; 399/125

(58) Field of Classification Search ..... 339/125, 339/110; 399/125, 110
See application file for complete search history.

(56) References Cited

U.S. PATENT DOCUMENTS 4,386,838 A 6/1983 Hirabayashi et al.
4,432,632 A 2/1984 Yokota
4,585,329 A 4/1986 Landa
4,615,605 A 10/1986 Kida et al.
4,634,264 A 1/1987 Takahashi
4,639,119 A 1/1987 Isaka
4,642,661 A 2/1987 Dean, II
4,657,372 A 4/1987 Ikeda et al.
4,668,076 A 5/1987 Iseki et al.
4,678,318 A 7/1987 Bisaiji
4,692,018 A 9/1987 Tamura
4,757,344 A 7/1988 Idenawa et al.
4,761,667 A 8/1988 Miyai et al.
4,791,454 A 12/1988 Takahashi et al.
4,862,212 A 8/1989 Tanzawa et al.
4,866,482 A 9/1989 Hirasawa et al.
4,896,193 A 1/1990 Kagiura et al.
4,924,267 A 5/1990 Yoshikawa et al.
4,926,219 A 5/1990 Hirasawa et al.
4,943,828 A 7/1990 Manabe et al.
4,987,446 A 1/1991 Mochimaru et al.
5,041,872 A 8/1991 Nukaya et al.
5,061,959 A 10/1991 Kinoshita et al.
5,086,316 A 2/1992 Aoki
5,153,640 A 10/1992 Okabe
5,160,963 A 11/1992 Haneda et al.
5,160,964 A 11/1992 Takahashi et al.
5,220,387 A 6/1993 Tsunoda et al.

(Continued)

*Primary Examiner*—Diego Gutierrez
*Assistant Examiner*—Mirellys Jagan
(74) *Attorney, Agent, or Firm*—Coats & Bennett

(57) ABSTRACT

An image forming device having a main body and a movable subunit. The subunit is movable between a first orientation and a second orientation. A developer member is positioned within the main body, and a photoconductive member is positioned on the subunit. In the first orientation, the developer member and photoconductive member are spaced apart. In the second orientation, the photoconductive member is positioned either in contact with or closely located to the developer member. Image formation occurs when the subunit is in the second orientation as toner is transferred from the developer member to the photoconductive member. Methods of using the image forming device include positioning the developer member in the main body and the photoconductive member on the subunit, and moving the subunit from a first orientation to a second orientation such that image formation can occur.

25 Claims, 8 Drawing Sheets

U.S. PATENT DOCUMENTS 5,245,357 A 9/1993 Maruyama et al.
5,249,026 A 9/1993 Kojima
5,253,028 A 10/1993 Gonda et al.
5,255,061 A 10/1993 Matsuura et al.
5,266,998 A 11/1993 Lee
5,276,479 A 1/1994 Inomata
5,294,960 A 3/1994 Nomura et al.
5,309,211 A 5/1994 Yoshioka
5,323,210 A 6/1994 Inomata
5,367,363 A 11/1994 Kai et al.
5,371,575 A 12/1994 Sekino et al.
5,402,212 A 3/1995 Ito et al.
5,440,373 A 8/1995 Deki et al.
5,442,421 A 8/1995 Kojima
5,452,064 A 9/1995 Inomata
5,528,343 A 6/1996 Tada et al.
5,537,187 A 7/1996 Sekine
5,585,889 A 12/1996 Shishido et al.
5,587,769 A 12/1996 Sawada et al.
5,619,309 A 4/1997 Yashiro et al.
5,646,720 A 7/1997 Song
5,659,847 A 8/1997 Tsuda et al.
5,682,579 A 10/1997 Nomura et al.
5,697,008 A 12/1997 Katoh et al.
5,699,091 A 12/1997 Bullock et al.
5,742,319 A 4/1998 Fukunaga et al.
5,745,824 A 4/1998 Yashiro
5,758,232 A 5/1998 Ikunami
5,787,323 A 7/1998 Nomura et al.
5,787,324 A 7/1998 Iwasaki
5,787,326 A 7/1998 Ogawa et al.
5,797,068 A 8/1998 Otsuki et al.
5,802,432 A 9/1998 Coffey et al.
5,815,644 A 9/1998 Nishiuwatoko et al.
5,839,032 A 11/1998 Yasui et al.
5,842,095 A 11/1998 Kitamura
5,887,228 A 3/1999 Motohashi et al.
5,897,244 A 4/1999 Miyazaki et al.
5,907,749 A 5/1999 Nomura et al.
5,907,751 A 5/1999 Kawaguchi et al.
5,920,752 A 7/1999 Karakama et al.
5,930,564 A 7/1999 Ookaji
5,937,240 A 8/1999 Kanno et al.
5,943,529 A 8/1999 Miyabe et al.
5,950,050 A 9/1999 Shirasaki et al.
5,966,566 A 10/1999 Odagawa et al.
5,978,626 A 11/1999 Nagamine et al.
6,041,203 A 3/2000 Suzuki et al.
6,075,958 A 6/2000 Gotoh et al.
6,118,961 A 9/2000 Nomura et al.
6,125,251 A 9/2000 Shiraishi et al.
6,134,404 A 10/2000 Iwai et al.
6,163,666 A 12/2000 Hosokawa et al.
6,173,140 B1 1/2001 Suzuki et al.
6,215,970 B1 4/2001 Yoshikawa et al.
6,330,410 B1 12/2001 Okabe
6,347,204 B1 2/2002 Kurosawa
6,366,749 B1 4/2002 Koumoto
6,377,765 B1 4/2002 Shishido et al.
6,384,940 B1 5/2002 Kawai et al.
6,453,135 B1 9/2002 Sameshima et al.
6,453,136 B1 9/2002 Yasumaru
6,477,346 B1 11/2002 Yahagi
6,498,915 B1 12/2002 Yamaguchi et al.
6,549,737 B1 4/2003 Sano et al.
2001/0028810 A1 10/2001 Yamaguchi et al.
2001/0055499 A1 12/2001 Sato
2002/0102110 A1 8/2002 Kida
2003/0049035 A1 3/2003 Ochiai et al.
2003/0049047 A1 3/2003 Suzuki et al.
2003/0068173 A1* 4/2003 Tanizaki et al. ..... 399/119
2003/0072586 A1 4/2003 Kamano et al.

* cited by examiner

MOVABLE SUBUNIT AND TWO PIECE CARTRIDGE FOR USE IN AN IMAGE FORMING DEVICE

BACKGROUND

Image forming devices require user intervention for proper operation. One user intervention is clearing the media path during a paper jam. Access to the media path is often difficult because of the complex mechanical design in existing devices. The media path may be located within the interior of the device making it very difficult to remove a jammed media sheet. Further, the user may have access to a limited section of the media path and be able to remove only a portion of the jammed media sheet. A torn remainder is left in the device that must somehow be removed prior to restarting image formation.

Another user intervention requires mounting cartridges within the device. Cartridge mounting may occur initially when the machine is first used, or throughout the device life to replace exhausted cartridges. The complex design again makes it difficult for the user to access the cartridges. Difficult cartridge mounting locations may also result in the user getting toner on their hands and fingers by inadvertently contacting the toner outlet on the cartridge.

Some existing devices provide for an adjustable media path and cartridge mounts to ease the user intervention. The media path and cartridge mounts may be positionable between an operational position during image formation, and a non-operational position to ease user access for media jam removal and cartridge installation respectively. It is important that these adjustable elements be accurately located in the operational position. Inaccurate locating of the elements may result in image forming defects, increased media jams, and other detrimental effects.

Further, the device should be constructed in an economical manner. Price is one of the leading factors when a user makes a purchasing decision. Improvements to user intervention should add to functionability, but not at a price that will drive away potential users.

SUMMARY

The present invention is directed to an image forming device having a main body and a movable subunit. In one embodiment, the subunit is movable between a first orientation that is spaced from the main body, and a second orientation that is either in contact with or closely located to the main body. A developer member is positioned within the main body, and a photoconductive member is positioned on the subunit. In the first orientation, the developer member and photoconductive member are spaced apart. Image formation occurs when the subunit is in the second orientation as toner is transferred from the developer member to the photoconductive member.

In one embodiment, an imaging device is positioned within the main body. One or more photoconductive members are positioned on a subunit that is movable relative to the main body. In a first orientation, the photoconductive members are spaced from the imaging device. In a second orientation, the photoconductive members are positioned within the main body and the imaging device can form an electrostatic latent image on the photoconductive members during image forming operations.

In another embodiment, a developer unit is located within the main body. The developer unit may include one or more of a developer member, toner sump, and agitating members.

A photoconductive unit is connected to the subunit and may include one or more of a photoconductive member, a charger, a cleaning unit, and an auger. When the subunit is in a first orientation, the developer units and the photoconductive units are accessible to a user. In a second orientation, the subunit is closed and the photoconductive member of each photoconductive unit is mounted against a developer member of each developer unit.

DETAILED DESCRIPTION

Figure 1:
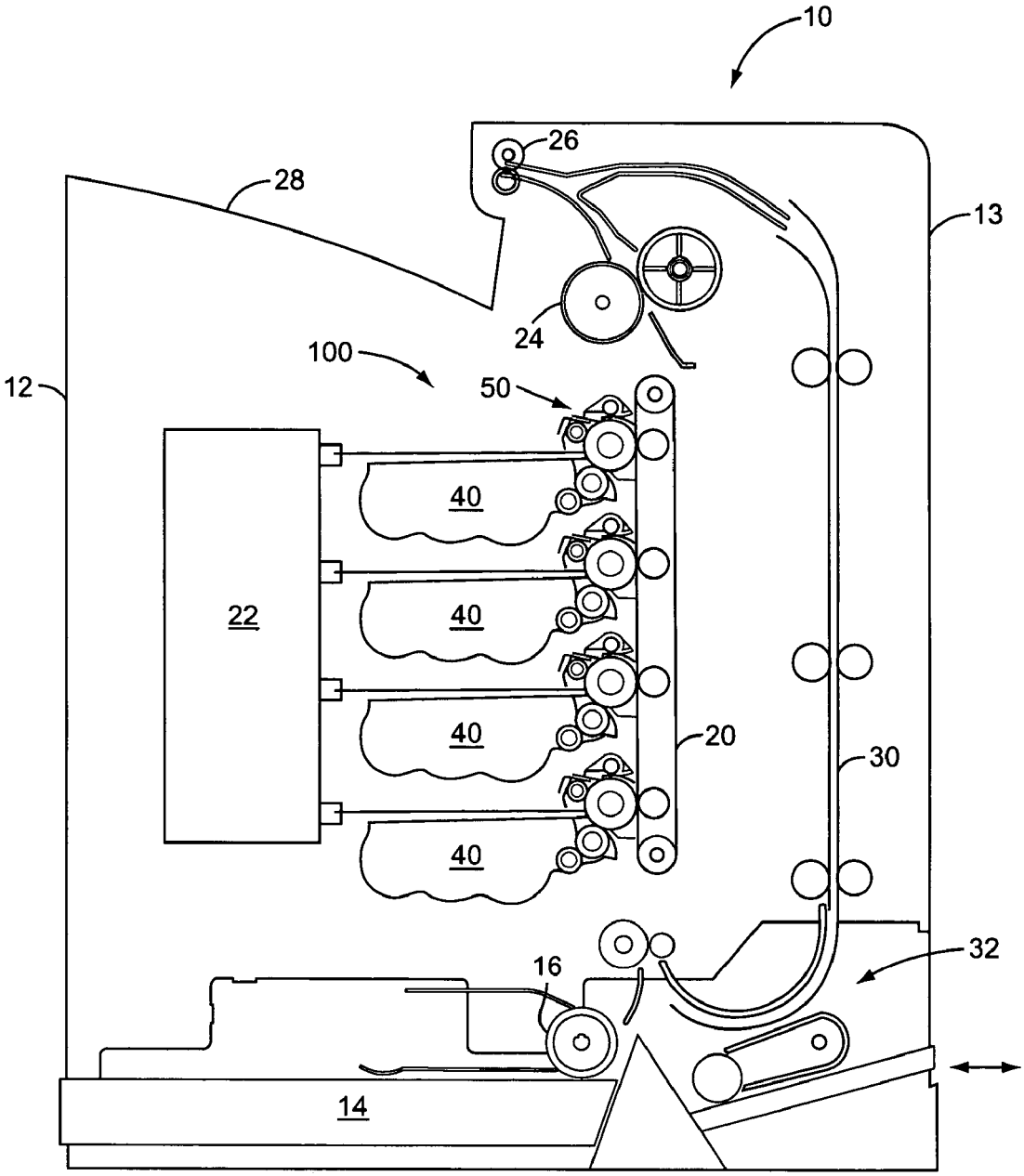
FIG. 1 is a schematic view of one embodiment of an image forming device constructed according to the present invention.

FIG. 1 depicts a representative image forming device, such as a printer, indicated generally by the numeral 10. The image forming device 10 comprises a main body 12 and a subunit 13. A media tray 14 with a pick mechanism 16, or a manual input 32, are conduits for introducing media sheets in the device 10. The media tray 14 is preferably removable for refilling, and located on a lower section of the device 10.

Media sheets are moved from the input and fed into a primary media path. One or more registration rollers disposed along the media path aligns the print media and precisely controls its further movement along the media path. A media transport belt 20 forms a section of the media path for moving the media sheets past a plurality of image forming units 100. Color printers typically include four image forming units 100 for printing with cyan, magenta, yellow, and black toner to produce a four-color image on the media sheet.

An imaging device 22 forms an electrical charge on a photoconductive member within the image forming units 100 as part of the image formation process. The media sheet with loose toner is then moved through a fuser 24 that adheres the toner to the media sheet. Exit rollers 26 rotate in a forward or a reverse direction to move the media sheet to an output tray 28 or a duplex path 30. The duplex path 30 directs the inverted media sheet back through the image formation process for forming an image on a second side of the media sheet.

Figure 5:
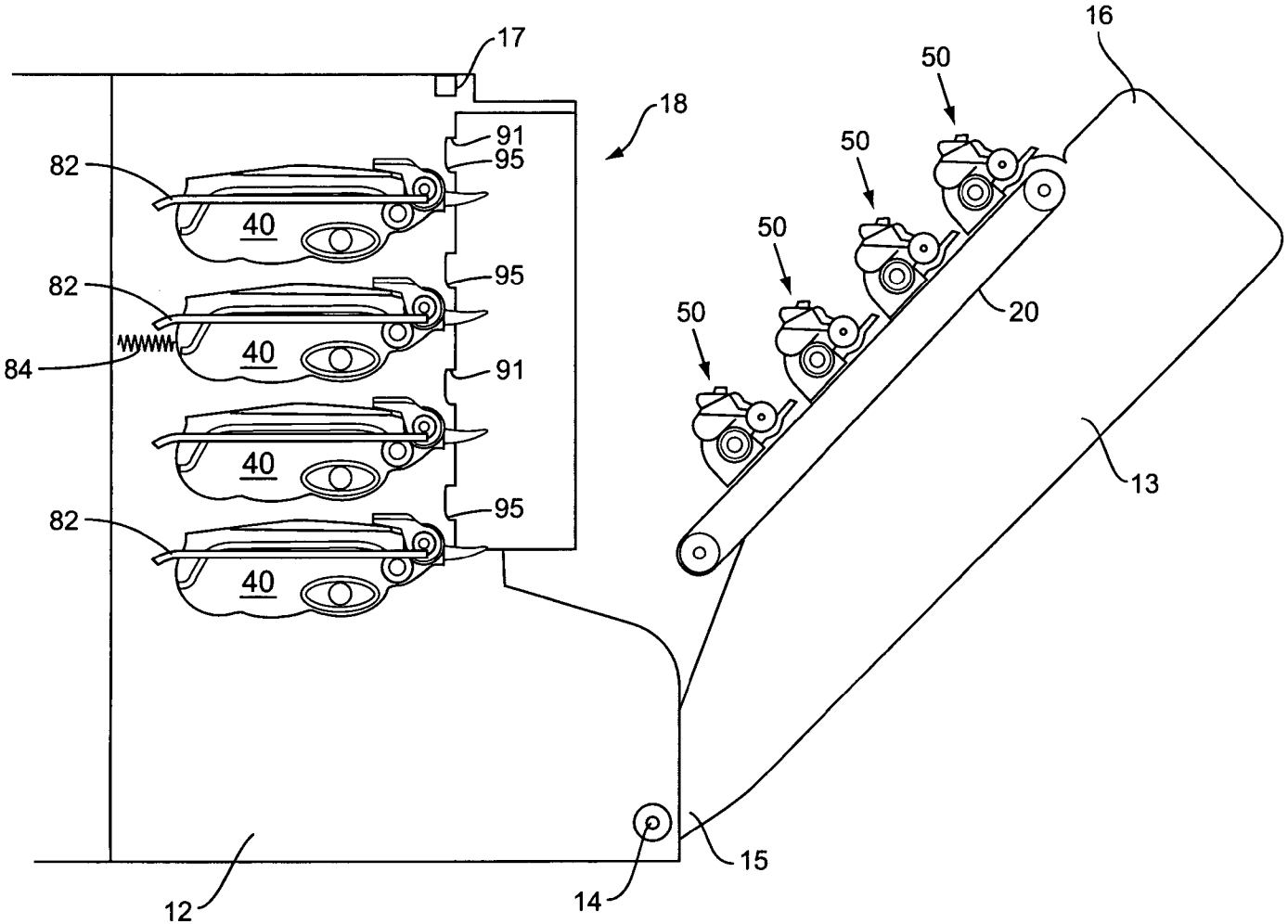
FIG. 5 is a cut-away side view of a subunit pivoted away from the main body according to one embodiment of the present invention.

The image forming units 100 are constructed of a developer unit 40 and a photoconductor unit 50. The developer unit 40, including a developer member 45, is positioned within the main body 12. The photoconductor unit 50, including a photoconductive member 51, is mounted to the subunit 13. In a closed orientation as illustrated in FIG. 1, the subunit 13 is positioned adjacent to the main body 12 with the photoconductive member 51 of the photoconductor unit 50 against the developer member 45 of the developer unit 40. In an open orientation as illustrated in FIG. 5, the subunit 13 is moved away from the main body 12 separating the photoconductor unit 50 from the developer unit 40. This configuration provides direct and easy user access to the developer unit 40, photoconductor unit 50, and the media path. It has been determined that the highest user intervention rates are at the developer unit 40, photoconductor unit 50, and media path.

Figure 2:
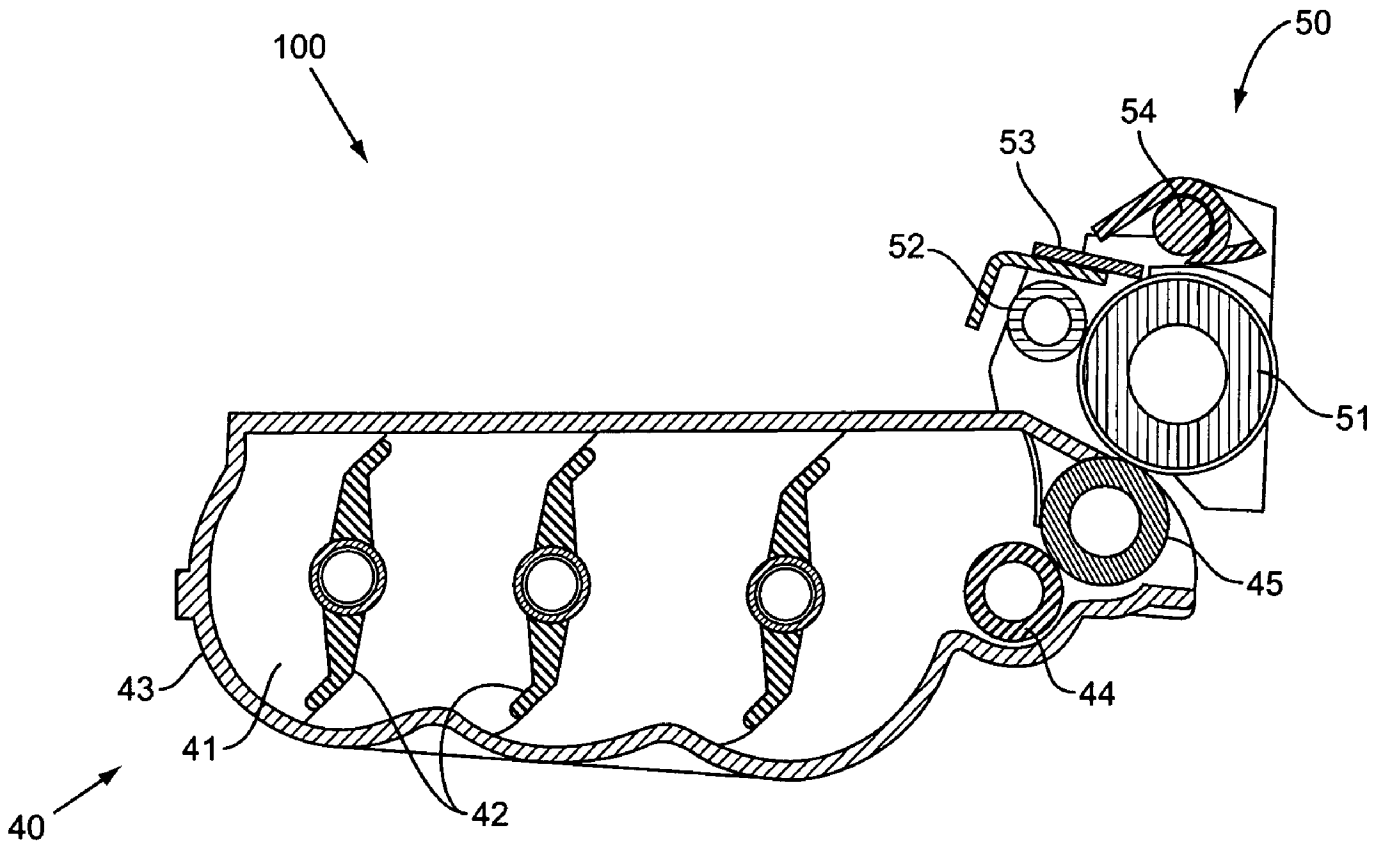
FIG. 2 is a cross-sectional view of an image forming unit constructed according to one embodiment of the present invention.
Figure 3:
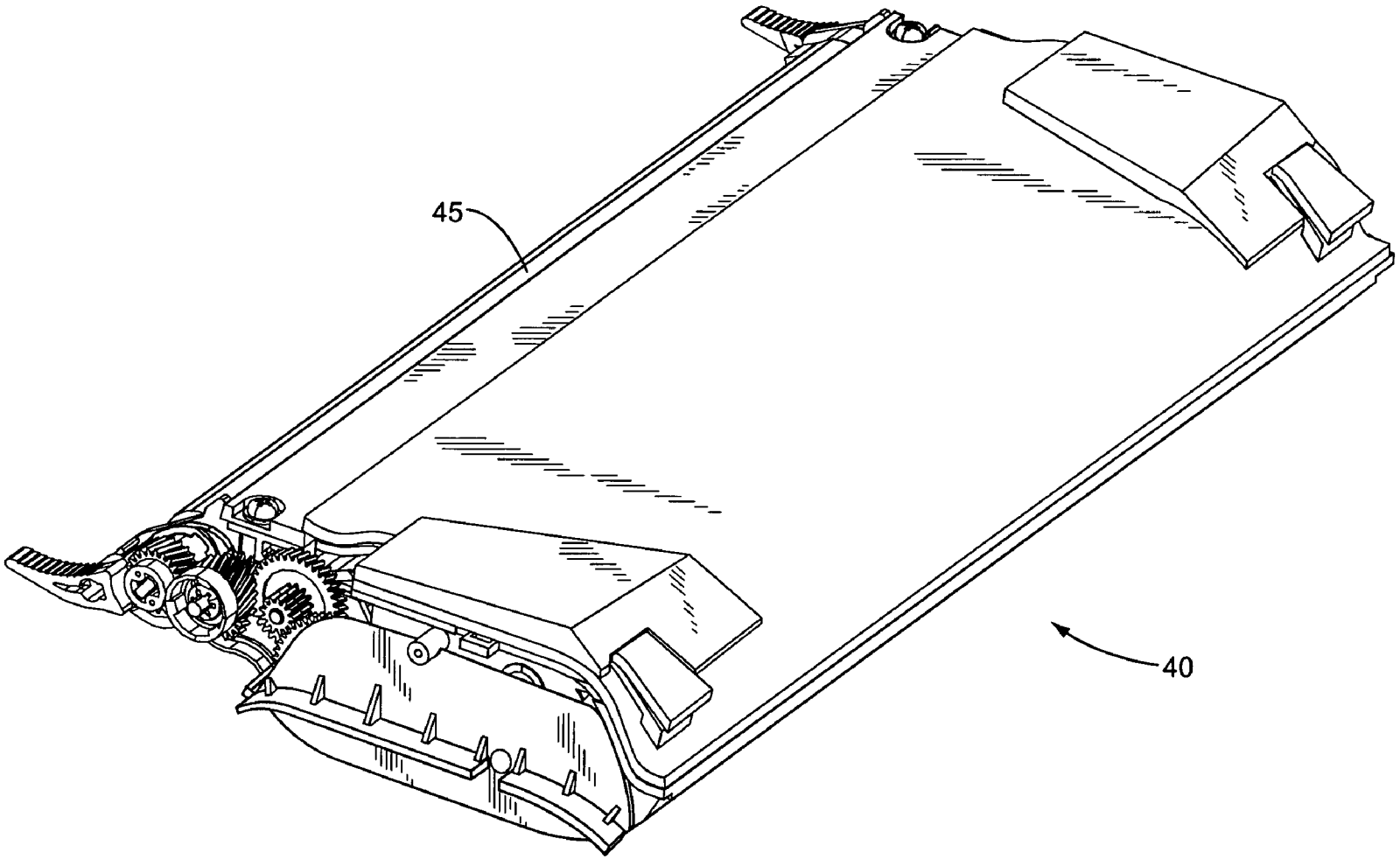
FIG. 3 is a perspective view of a developer unit constructed according to one embodiment of the present invention.

FIG. 2 illustrates a cross-sectional view of the image forming unit 100 in the closed orientation. The developer unit 40 comprises an exterior housing 43 that forms a reservoir 41 for holding a supply of toner. One or more agitating members 42 are positioned within the reservoir 41 for agitating and moving the toner towards a toner adder roll 44 and the developer member 45. Toner moves from the reservoir 41 via the one or more agitating members 42, to the toner adder roll 44, and finally is distributed to the developer member 45. The developer unit 40 is structured with the developer member 45 on an exterior section where it is accessible for being in contact with the photoconductive member 51 as illustrated in FIG. 3.

Figure 4:
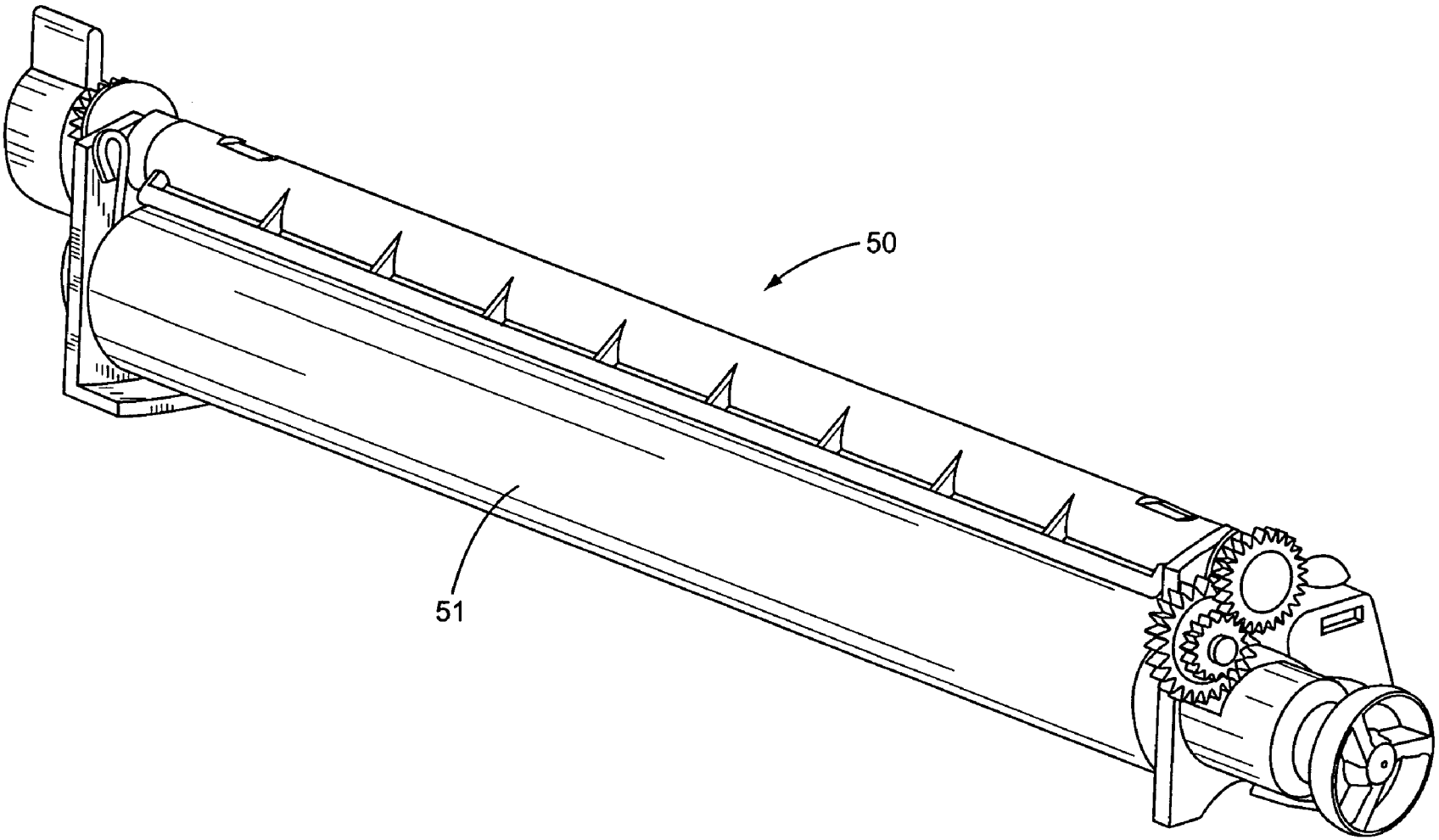
FIG. 4 is a perspective view of a photoconductor unit constructed according to one embodiment of the present invention.

The photoconductor unit 50 is illustrated in FIG. 2 and comprises the photoconductive member 51. In one embodiment, the photoconductive member 51 is an aluminum hollow-core drum coated with one or more layers of light-sensitive organic photoconductive materials. The photoconductor unit 50 may also include a charger 52 that applies an electrical charge to the photoconductive member 51 to receive an electrostatic latent image from the imaging device 22. A cleaner blade 53 contacts the surface of the photoconductive member 51 to remove any toner that remains on the photoconductive member 51. The residual toner is moved to a waste toner auger 54 and moved out of the photoconductor unit 50. A pair of mounts (not illustrated) attaches the photoconductor unit 50 to the subunit 13. As illustrated in FIG. 4, the photoconductive member 51 is mounted on an exterior of the photoconductor unit 50 so it may be placed in contact with the developer member 45.

In this two-piece cartridge architecture, the developer unit 40 and photoconductor unit 50 are mounted to ensure good contact axially across a print zone between the developer member 45 in the developer unit 40 and the photoconductive member 51 in the photoconductor unit 50. The mounting of each of the developer unit 40 and photoconductor unit 50 is important for the axial contact.

Figure 6:
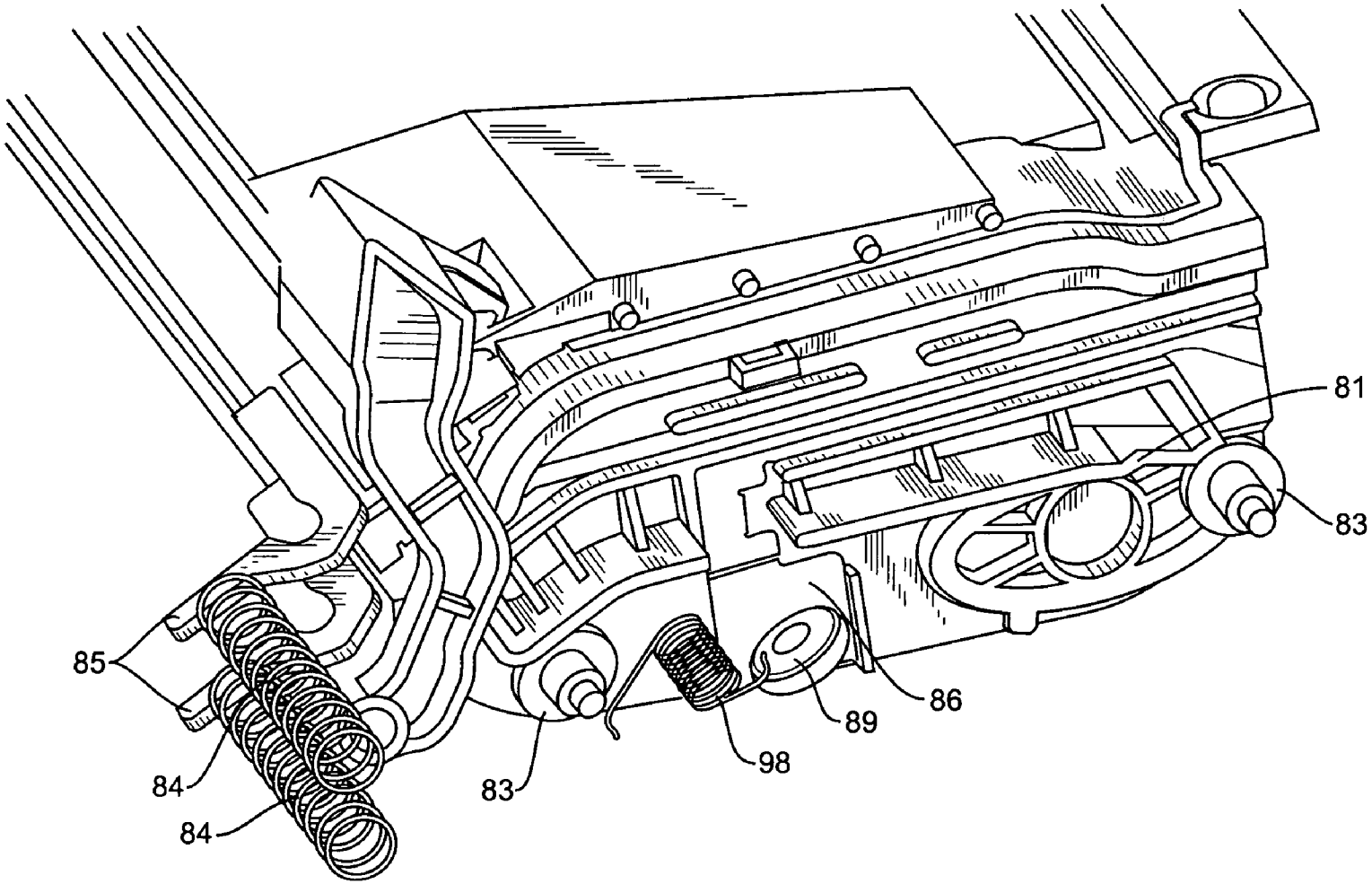
FIG. 6 is a partial perspective view of one side of the developer unit constructed according to one embodiment of the present invention.
Figure 7:
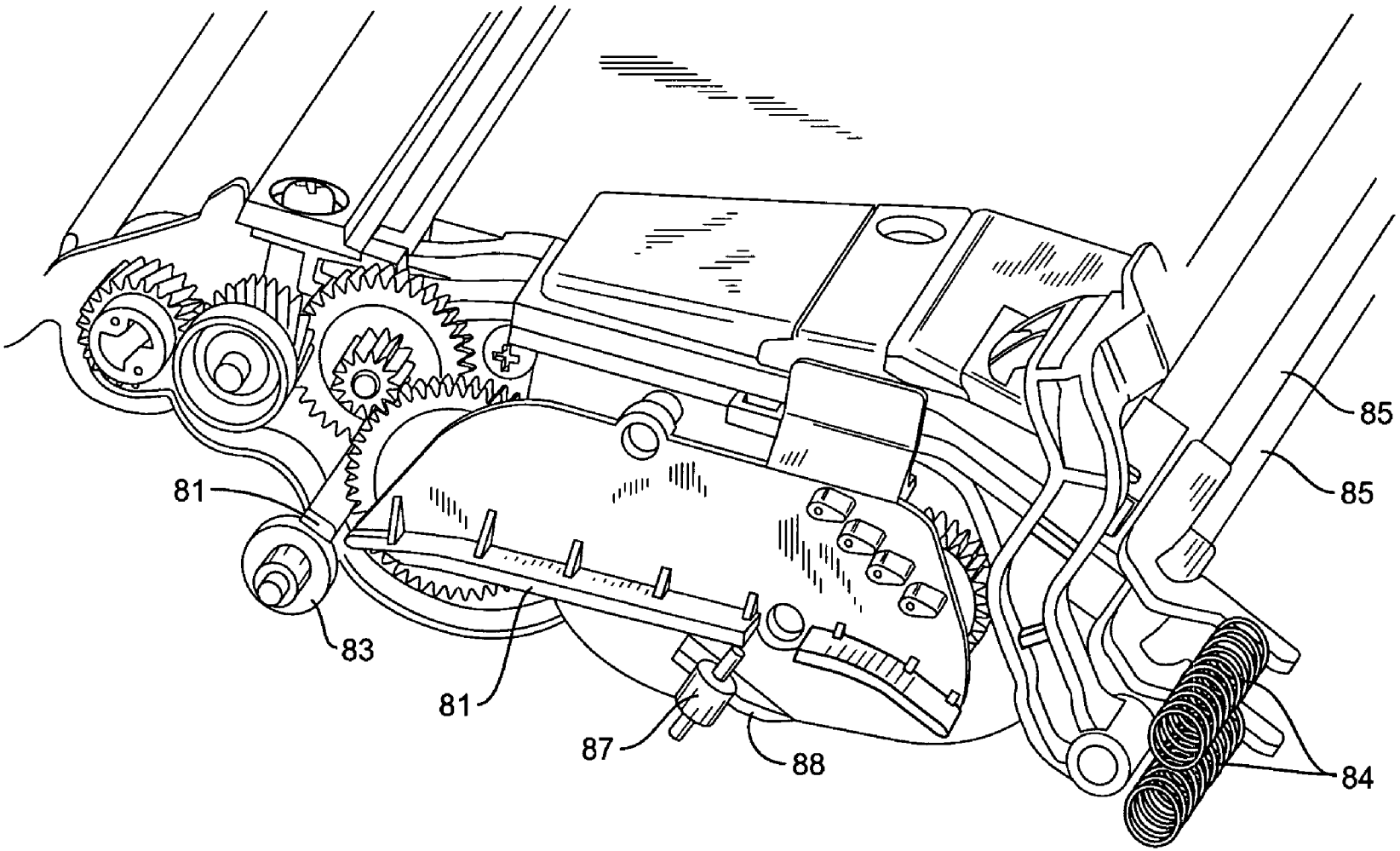
FIG. 7 is a partial perspective view of a second side of the developer unit constructed according to one embodiment of the present invention.

The developer unit 40 is located within the main body 12 along three separate dimensional planes. In a first plane, feet 81 extend from two sides of the developer unit 40. One or more rollers 83 are positioned within the main body 12 and extend outward to support the feet 81. In one embodiment illustrated in FIGS. 6 and 7, a first side (FIG. 6) of the developer unit 40 is supported by two rollers 83, and a second side (FIG. 7) is supported by one roller 83. The feet 81 are also used for mounting the developer unit 40 within the main body 12 as the feet 81 slide along the rollers 83. In one embodiment, the rollers 83 rotate as the feet 81 slide along during installation and removal of the developer unit 40. In another embodiment, rollers 83 are stationary and the rounded edge slides along the feet 81. Guide rails 82 may extend outward from the main body 12 along each side of the developer unit 40 and align with the rollers 83 (FIG. 5).

In a second plane, the developer unit 40 is biased by a plurality of electrical contacts 85 that include a biasing mechanism 84 mounted to the main body 12. The electrical contacts 85 apply a force outward from the main body 12 (i.e., towards the right as illustrated in FIG. 5). One embodiment of the electrical contacts is described in U.S. patent application Ser. No. 10/804,691 entitled "Variable Force Biasing Mechanism and Electrical Connection" filed on Mar. 1, 2004 and assigned to Lexmark International, Inc., the owner of the present application, and herein incorporated by reference in its entirety. In another embodiment, location in the second plane is accomplished by one or more biasing mechanisms 84 that extend between the main body and a back edge of the developer unit 40 as schematically illustrated in FIG. 5.

Developer unit 40 is located in a third plane by a biasing force applied against a pad 86 on a first side. The force is applied to the pad 86 by a roller 89 within the main body 12 to force the developer unit 40 laterally within the main body 12 (i.e., into the page as illustrated in FIG. 5). The roller 89 is biased against the pad 86 by a biasing mechanism 98, such as a torsion spring. This force pushes the gear side of developer unit 40 (FIG. 7) against coupling members in the main body 12. The contact member 88 on the second side abuts against a stop pin 87 within the main body 12 to position the developer unit 40 and control the lateral position. Stop pin 87 and roller 89 have rounded surfaces to compensate for movement of the developing unit 40 relative to the main body 12.

The locating features that bias the developer unit 40 along the three separate dimensional planes allow the unit 40 to move in all three directions instead of being rigidly locked in a fixed position. This allows the nip force acting on the developer member 45 when contacting the photoconductive member 51 to position the developer unit 40 such that the developer member 45 axially contacts the photoconductive member 51 completely and with the necessary nip force.

The photoconductor unit 50 attaches to the subunit 13 as illustrated in FIG. 5. Mounts extend outward to attach to and place the photoconductor unit 50 on an inner side of the subunit 13. In one embodiment, mounts are positioned on both ends of the photoconductor unit 50. The mounts do not locate the photoconductor unit 50, but rather provide a means for the unit 50 to remain attached to the subunit 13 in the open orientation. One embodiment of the mounts is disclosed in U.S. patent Ser. No. 10/804,551 entitled "Door Assembly for an Image Forming Device" filed concurrently with the present application, assigned to Lexmark International, Inc., and herein incorporated by reference in its entirety.

Figure 8:
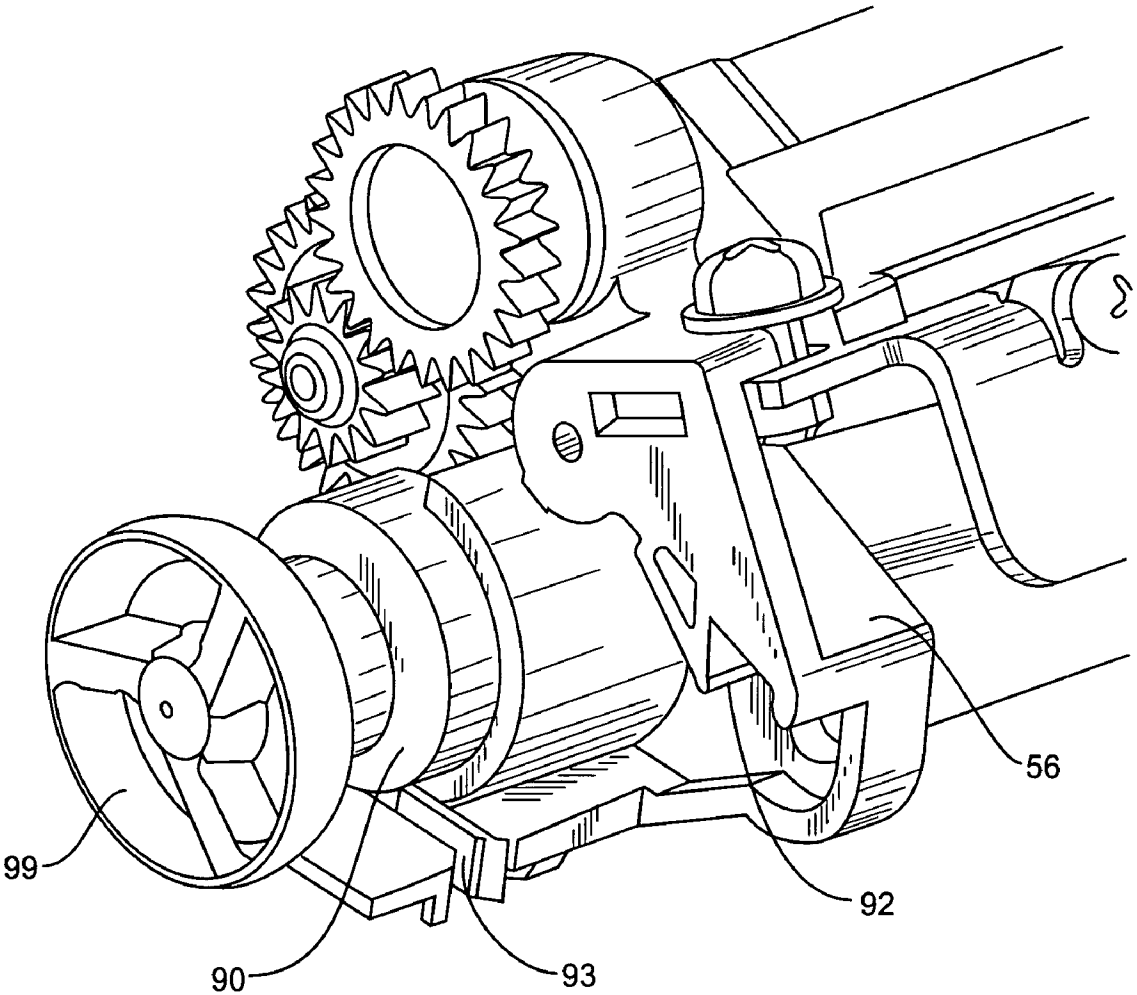
FIG. 8 is a partial perspective view of one side of the photoconductor unit according to one embodiment of the present invention.

When the subunit 13 is in the closed orientation, the photoconductor unit 50 is located along three dimensional planes. In a first plane, ball bearings 90 are positioned at each end of the photoconductor member 51. The ball bearings 90 locate within a block 91 within the main body 12. In one embodiment as illustrated in FIG. 8, photoconductor member 51 is an elongated drum and the ball bearings 90 are positioned towards each end of the drum.

The photoconductor unit 50 is located in a second plane via stop features 92. The stops 92 are positioned in the housing 56 of the photoconductor unit 50 and ensure the correct rotational position of the photoconductive member 50 onto the developer member 45. When the subunit 13 is moved to the closed orientation and torque is applied to the coupler 99 from a driving mechanism within the main body 12, the photoconductor unit 50 rotates and is located by the stops 92 seating against the ends of guide rails 82 in the main body 12 (FIG. 5). In one embodiment, one stop 92 is positioned at each end of the photoconductor unit 50.

Location in a third plane is established through a v-notch feature 93 in the photoconductor unit 50. The v-notch features includes first and second edges that straddle a mating point 95 in the main body. In one embodiment, a v-notch feature 93 is positioned at opposing ends of the photoconductor unit 50 and each mates with a corresponding mating point 95 within the main body 12.

When the device 10 is in the open orientation, the developer units 40 can be individually removed and replaced as necessary. By way of example and using the embodiment of FIG. 5, the upper developer unit 40 can be removed from the main body 40 without disturbing the remaining developer units 40. In one embodiment, the developer unit 40 is removed by pulling the unit outward away from the main body 12. A replacement developer unit 40 can be inserted into the resulting gap by applying an opposite force such that the developer unit 40 is located along the three dimensional planes. Likewise, any of the photoconductive units 50 can be removed and replaced from the subunit 13. Again by way of example and using FIG. 5 as an example, the second photoconductor unit 50 from the upper edge of the subunit may be removed without interfering with the remaining units 50. In one embodiment, photoconductor unit 50 is removed by lifting the unit 50 from the mounts positioned on the subunit 13. A replacement unit 50 is reinserted by attaching the mounts to the subunit. The photoconductor unit 50 is loosely attached to the subunit 13 to ease the burden of removing jammed sheets on the media path, and replacing the unit 50 on the subunit 13.

The subunit 13 results in locating the photoconductive units 50 relative to the corresponding developer units 40. As the subunit 13 closes and the driving mechanism in the main body rotates the coupler 99, the photoconductive units 50 are located along the three dimensional planes. The developer units 40 are located along the three planes as the photoconductive member 51 abuts against the developer member 45. This positioning of the photoconductive member 51 against the developer member 45 allows for toner to pass during the image formation process. In one embodiment, the only contact between the mating developer units 40 and photoconductive units 50 is the contact between the developer members 45 and the photoconductive members 51.

The design provides for most of the developing forces acting on the image forming units 100 to be developed when the subunit 13 is initially placed into the closed orientation. For the developing unit 40, forces are applied along each of the three planes. For the photoconductor unit 50, the forces are completed once torque is applied through the coupler 99 and the stops 92 seat against the ends of guide rails 82 to completely locate the unit with the developer member 45 in contact with the photoconductive member 51. Once the subunit 13 is opened, the forces are removed as the photoconductive member 51 moves away from the developer member 45.

A two-piece cartridge design with pivoting subunit is disclosed in concurrently filed U.S. patent application Ser. No. 10/804,488 titled "Image Forming Device having a Door Assembly and Method of Use" which is assigned to Lexmark International, Inc., and incorporated herein by reference in its entirety.

The term "image forming device" and the like is used generally herein as a device that produces images on a media sheet 50. Examples include but are not limited to a laser printer, ink-jet printer, fax machine, copier, and a multifunctional machine. One example of an image forming device is Model No. C750 referenced above.

The term "imaging device" refers to a device that arranges an electrical charge on the photoconductive element 51. Various imaging devices may be used such as a laser printhead and a LED printhead.

A transport belt 20 is illustrated in the embodiments for moving the media sheets past the image forming units 100, and as part of the subunit. In another embodiment, roller pairs are mounted to the subunit 13 and spaced along the media path. The roller pairs move the media sheets past the image forming units 100. In one embodiment, each of the roller pairs is mounted on the subunit 13. In another embodiment, one of the rollers is mounted on the subunit, and the corresponding roller of the pair is mounted on the main body 12. In yet another embodiment, rollers may be positioned within the photoconductor unit 50.

The present invention may be carried out in other specific ways than those herein set forth without departing from the scope and essential characteristics of the invention. In one embodiment, both the photoconductive member 51 and the developer member 45 are cylindrically shaped. The present embodiments are, therefore, to be considered in all respects as illustrative and not restrictive, and all changes coming within the meaning and equivalency range of the appended claims are intended to be embraced therein.

What is claimed is:

1. An image forming device comprising:

a main body;

a plurality of first units mounted to the main body and each having a developer member;

a subunit connected to and movable relative to the main body;

a plurality of second units mounted to the subunit during image formation and open orientations, each of the plurality of second units having a photoconductive member;

the subunit being movable between an open orientation in which the plurality of photoconductive members are spaced remotely from the plurality of developer members, and an image formation orientation in which each of the plurality of photoconductive members receives toner from a corresponding one of the plurality of developer members;

the subunit forming an exterior wall of the main body when the subunit is in the image formation orientation.

2. The device of claim 1, wherein each of the plurality of first units is located along three dimensional planes by a plurality of biasing members.

3. An image forming device comprising:

a main body;

a plurality of developer members mounted to the main body;

a subunit connected to and movable relative to the main body with a transport belt mounted to the subunit;

a plurality of photoconductive members mounted on the subunit;

the subunit movable between a first orientation in which each of the plurality of photoconductive members mounted to the subunit are spaced remotely from the plurality of developer members, and a second orientation in which each of the plurality of photoconductive members mounted to the subunit is positioned against one of the plurality of developer members to receive toner during the image formation;

the subunit and the plurality of photoconductive members being movable about a common point and remaining in contact when moving between the first orientation and the second orientation.

4. The device of claim 3, wherein the subunit is an access door pivotably mounted to the main body.

5. The device of claim 3, wherein each of the plurality of developer members is part of a developer unit having a toner sump for holding the toner.

6. The device of claim 3, wherein each of the plurality of photoconductive members and each of the plurality of developer members are aligned relative to the main body when the subunit is in the second orientation.

7. The device of claim 3, wherein each of the plurality of developer members is located within the main body by being supported in a first plane, a second plane, and a third plane by biasing members.

8. The device of claim 3, wherein each of the plurality of photoconductive members is part of a photoconductive unit having a charger.

9. The device of claim 8, wherein the photoconductive unit further comprises a cleaner for removing toner.

10. An image forming device comprising:

a main body having an imaging device;

a developer member mounted to the main body;

a subunit connected to and movable relative to the main body;

a photoconductive member mounted on the subunit during image formation;

a transport belt mounted on the subunit to move media sheets past each of the plurality of photoconductive members during image formation;

the subunit movable between a first orientation in which the photoconductive member mounted to the subunit is spaced remotely from the developer member, and a second orientation in which the photoconductive member receives an electrostatic latent image from the imaging device during the image formation;

the transport belt and the photoconductive member remaining in contact and being movable about a common point when moving between the first and second orientations.

11. The device of claim 10, wherein the photoconductive member and the developer member are in contact during in the second orientation.

12. The device of claim 10, wherein the subunit is pivotally attached to the main body such that the photoconductive member moves relative to the imaging device when the subunit moves between the first and second orientations.

13. The device of claim 10, further comprising a charger attached to the subunit to electrically charge the photoconductive member.

14. The device of claim 10, further comprising a cleaner member attached to the subunit to remove toner from the photoconductive member.

15. An image forming device comprising:

a main body having an imaging device;

a plurality of developer members mounted to the main body;

a subunit connected to and movable relative to the main body between an open orientation in which the subunit is spaced from the main body, and an image forming orientation in which the subunit is positioned adjacent to the main body;

a plurality of photoconductive members and a transport belt mounted on the subunit, the photoconductive members remaining in contact with the transport belt during both the image forming and open orientations;

the subunit being movable between the open orientation in which the plurality of photoconductive members are spaced remotely from the plurality of developer members, and the image forming orientation in which each of the plurality of photoconductive members receives an electrostatic latent image from the imaging device.

16. The device of claim 15, wherein each of the plurality of developer members is in contact with one of the plurality of photoconductive members to transfer toner when the subunit is in the image forming orientation.

17. An image forming device comprising:

a main body;

a first unit having a developer member, doctor blade, and toner sump to house toner;

a subunit connected to and movable relative to the main body;

a transport belt mounted on the subunit;

a second unit mounted to the subunit during both image forming and non-image forming orientations, the second unit having a photoconductive member and a cleaner to remove the toner from the photoconductive member;

the subunit being movable relative to the main body between the non-image forming orientation in which the photoconductive member is spaced remotely from the developer member, and the image forming orientation in which toner moves from the toner sump to the developer member and is transferred to the photoconductive member;

the subunit and the second unit being movable about a common point when moved between the image forming and non-image forming orientations.

18. The device of claim 17, wherein developer member is in contact with the photoconductive member in the image forming orientation.

19. A method of forming an image with an image forming device comprising the steps of:

mounting a first unit having a developer member within a main body;

mounting a second unit having a photoconductive member on a subunit, the subunit including an exterior section of the image forming device and a transport belt;

moving the subunit with the mounted photoconductive member about a common pivot point to a first orientation with the photoconductive member spaced remotely from the developer member;

moving the subunit about the common pivot point to a second orientation with the photoconductive member remaining mounted to the subunit and receiving toner from the developer member; and forming an image with the subunit in the second orientation.

20. The method of claim 19, wherein forces acting on the first unit are developed with the subunit in the second orientation.

21. The method of claim 20, wherein the second unit is completely mounted after a torque is applied to the photoconductive member.

22. A method of forming an image with an image forming device comprising the steps of:

moving a subunit to a first orientation relative to an imaging device, the subunit including a transport belt;

attaching a photoconductive member to the subunit in an exposed position while the subunit is in the first orientation;

attaching a developer member to a main body with the developer member being exposed while the subunit is in the first orientation;

moving the subunit and the photoconductive member about a common pivot point to a second orientation with the photoconductive member in contact with the developer member and the subunit forming an exterior section of the device; and forming an image with the subunit in the second orientation by transferring toner from the developer member to the photoconductive member.

23. The method of claim 22, wherein the step of moving the subunit to a second orientation with the photoconductive member adjacent to the developer member comprises contacting the photoconductive member against the developer member.

24. A method of forming an image with an image forming device comprising the steps of:

locating a developer member within a main body relative to an imaging device;

connecting a photoconductive member with a transport belt on a subunit that is movable between a first orientation that is spaced from the main body, and a second orientation that is adjacent to the main body and forms a section of the exterior of the device;

moving the subunit from the first orientation to the second orientation about a pivot point and locating the photoconductive member relative to the main body with the developer member and photoconductive member being in contact; and forming an electrostatic latent image on the photoconductive member when the subunit is in the second orientation.

25. The method of claim 24, further comprising applying a torque to the photoconductive member and locating the photoconductive member relative to the imaging device.

* * * * *